US009877582B2

(12) United States Patent
Zhu et al.

(10) Patent No.: US 9,877,582 B2
(45) Date of Patent: Jan. 30, 2018

(54) CENTERING-ROTARY POSITIONING AUTOMATIC CLOSING DEVICE

(71) Applicant: WUXI HAIDAER PRECISION SLIDES CO., LTD, Wuxi, Jiangsu (CN)

(72) Inventors: Guangda Zhu, Jiangsu (CN); Linming Zhou, Jiangsu (CN); Haiwen Zhang, Jiangsu (CN)

(73) Assignee: WUXI HAIDAER PRECISION SLIDES CO., LTD, Wuxi, Jiangsu (CN)

( * ) Notice: Subject to any disclaimer, the term of this patent is extended or adjusted under 35 U.S.C. 154(b) by 0 days.

(21) Appl. No.: 15/037,647

(22) PCT Filed: Dec. 27, 2014

(86) PCT No.: PCT/CN2014/095228
§ 371 (c)(1),
(2) Date: May 18, 2016

(87) PCT Pub. No.: WO2015/096815
PCT Pub. Date: Jul. 2, 2015

(65) Prior Publication Data

US 2016/0296015 A1 Oct. 13, 2016

(30) Foreign Application Priority Data

Dec. 29, 2013 (CN) ..... 2013 1 0735966

(51) Int. Cl.
*A47B 88/04* (2006.01)
*A47B 88/467* (2017.01)
*A47B 88/49* (2017.01)

(52) U.S. Cl.
CPC ..... *A47B 88/047* (2013.01); *A47B 88/467* (2017.01); *A47B 88/49* (2017.01);
(Continued)

(58) Field of Classification Search
CPC ..... A47B 88/047; A47B 88/49; A47B 88/467; A47B 88/0481
(Continued)

(56) References Cited

U.S. PATENT DOCUMENTS 8,939,525 B1 * 1/2015 Chen ..... A47B 88/047 312/333
2009/0115300 A1 * 5/2009 Chen ..... A47B 88/467 312/334.1

(Continued)

*Primary Examiner* — James O Hansen

(57) ABSTRACT

A centering-rotary positioning automatic closing device includes a sliding rail installed on a fixed rail in a sliding from; wherein a guiding holder is mounted on a bottom of the fixed rail; a guiding part is mounted on the guiding holder along a sliding direction of the sliding rail; a sliding block is installed on the guiding part of the guiding holder and the guiding holder is connected to the sliding block through a spring; the guiding part has a guiding slot; a centering boss and a rotary boss are provided on a bottom of a bottom plate of a toggle block; the centering boss passes through a fixing hole of the sliding block, and the rotary boss passes through a rotary slot of the sliding block and extends into the guiding slot; a front end of the guiding slot has a positioning slot communicating with the guiding slot.

9 Claims, 16 Drawing Sheets

(52) U.S. Cl.
CPC ..... *A47B 2210/0018* (2013.01); *A47B 2210/0054* (2013.01)

(58) Field of Classification Search
USPC ..... 312/330.1, 333, 319.1, 334.1, 334.8, 312/334.47
See application file for complete search history.

(56) References Cited

U.S. PATENT DOCUMENTS

| | | | | |
|---|---|---|---|---|
| 2010/0026152 | A1* | 2/2010 | Huang | A47B 88/463 312/319.1 |
| 2011/0043087 | A1* | 2/2011 | Shih | A47B 88/467 312/334.1 |
| 2013/0028544 | A1* | 1/2013 | Lowe | A47B 88/047 384/21 |
| 2015/0131929 | A1* | 5/2015 | Park | A47B 88/467 384/21 |

* cited by examiner

CENTERING-ROTARY POSITIONING AUTOMATIC CLOSING DEVICE

CROSS REFERENCE OF RELATED APPLICATION

This is a U.S. National Stage under 35 U.S.C 371 of the International Application PCT/CN2014/095228, filed Dec. 27, 2014, which claims priority under 35 U.S.C. 119(a-d) to CN 201310735966.5, filed Dec. 29, 2013.

BACKGROUND OF THE PRESENT INVENTION

Field of Invention

The present invention relates to a technical field of rails, and more particularly to a centering-rotary positioning automatic closing device.

Description of Related Arts

In conventional drawer structures with automatic closing devices, sliding positioning column automatic closing devices are mostly adapted. For example, referring to FIGS. 15-16 of Chinese patent CN101052328B, a sliding board self-closing device is disclosed. Because a moving pin 34 needs a free space between a movable member 35 and a plate-shaped fixing member 36, the moving pin 34 is easy to be tilted under a pulling force of a tension spring due to a large gap between the movable member 35 and the plate-shaped fixing member 36, resulting in slip or failure. In addition, since a moving pin linear guider 38 of an extending part 37 of the plate-shaped fixing member 36 and a curve guider 39 are perpendicular to and communicate with each other, when pushing an internal movable rail so that the moving pin 34 moves from the moving pin linear guider 38 to the curve guider 39, sudden resistance increase is easy to be felt, which affects sensory quality of users. Furthermore, the structure takes up a large space, and a corresponding rail needs a lot of machining processes.

SUMMARY OF THE PRESENT INVENTION

Problem to be Solved

For solving the above problems, the present invention is to provide a centering-rotary positioning automatic closing device, wherein a structure thereof is simple and compacted; no resistance is felt even if the centering-rotary positioning automatic closing device is slowly pushed in, which not only improves sensory quality of user operation, but also is stable in positioning as well as difficult to drop.

Embodiment

Accordingly, the centering-rotary positioning automatic closing device, comprising: a fixed rail and a sliding rail, wherein the fixed rail is fixed on an object, the sliding rail is mounted on a slider which relatively moves on the object, and the sliding rail is installed on the fixed rail in a sliding form; wherein the centering-rotary positioning automatic closing device further comprises a guiding holder, a sliding block and a toggle block, wherein the guiding holder is mounted on a bottom of the fixed rail; a guiding part is mounted on the guiding holder along a sliding direction of the sliding rail; the sliding block is installed on the guiding part of the guiding holder and is movable along the guiding part; the guiding holder is connected to the sliding block through a spring; the guiding part has a guiding slot along the sliding direction of the sliding rail; the toggle block comprises a toggle part; a centering boss and a rotary boss are provided on a bottom of the toggle part; the sliding block has a fixing hole corresponding to the centering boss and a rotary slot corresponding to the rotary boss; the centering boss passes through the fixing hole of the sliding block, and the rotary boss passes through the rotary slot of the sliding block and extends into the guiding slot; when the sliding block moves towards the guiding part, the rotary boss synchronically moves in the guiding slot; a front end of the guiding slot has a positioning slot communicating with the guiding slot; when the rotary boss moves into the positioning slot along the guiding slot, the toggle block rotates towards an opening direction of the sliding rail with the centering boss as a shaft, while the rotary boss rotates in the positioning slot along the rotary slot; the toggle part is mounted on a bottom board of the toggle block, and the toggle part has a concave opening slot; a clutched block is provided on a bottom of the sliding rail, which is clutched in the concave opening slot; a first slot opening end face of the concave opening slot at a sliding rail opening direction side is lower than a second slot opening end face of the concave opening slot at a sliding rail closing direction side.

Furthermore, the centering boss is an annular boss; after passing through the fixing hole of the sliding block, the centering boss is connected to and fixed on the sliding block through a connecting rivet; wherein the connecting rivet passes through an annular internal hole of the centering boss. A positioning face of the positioning slot is an arc face extending towards the opening direction of the sliding rail, and the positioning slot is transition-connected to the guiding slot through the arc face. A convex block is provided on the rotary boss, and the convex block hooks a bottom of the sliding block after passing through the rotary slot. A reset auxiliary structure is provided on the toggle block; wherein the reset auxiliary structure comprises an extending part provided on the toggle part at the sliding rail opening direction side; a flange is provided on the extending part at the sliding rail opening direction side, and a wedge-shaped face is provided on the flange at the sliding rail opening direction side; a ditch is formed by the toggle part, the flange and the extending part between the toggle part and the flange, and the clutched block of the sliding rail is clutched in the ditch. A stopper arc end is provided at a top end of the flange at the sliding rail closing direction side. The concave opening slot is a U-shaped opening slot; the clutched block of the sliding rail is cylindrical. The guiding holder comprises a base and the guiding part, wherein the guiding part is perpendicularly integrated with the base, and the base is mounted on the bottom of the fixed rail. A bottom of the sliding block has a concave clutching slot, and the guiding part of the guiding holder is clutched in the concave clutching slot. Spring installation holders are arranged at both sides of the guiding holder and both sides of the sliding block; two ends of the spring are respectively mounted in the spring installation holders at the guiding holder and the sliding block. The guiding slot is stepped; the rotary slot is an arc rotary slot; the centering boss is a stepped boss; and the fixing hole is a stepped hole.

Beneficial Effects

According to the present invention, when the sliding rail and the fixed rail are closed, the rotary boss is located at a bottom of the guiding slot of the guiding holder, and the clutched block on the sliding rail is located at the concave opening slot of the toggle part of the toggle block. When the sliding rail slides forward, the clutched block on the sliding rail carries the toggle block to synchronically move. Meanwhile, the toggle block uses the centering boss to drive the guiding part of the guiding holder of the sliding block to move forward. During a process that the clutched block drives the toggle block to move so that the toggle block and the sliding block move to a most front end of the guiding slot, the rotary boss of the toggle block synchronically moves in the guiding slot. Driven by the clutched block, the toggle block trends to rotate towards the opening direction of the sliding rail with the centering boss as the shaft, meanwhile the rotary boss is limited by the guiding slot and is not able to rotate along the rotary slot of the sliding block. During a process that the clutched block drives the toggle block and the sliding block to move to the most front end of the guiding slot and enter the positioning slot, the toggle block rotates towards the opening direction with the centering boss as the shaft, while the rotary boss rotates into the positioning slot along the rotary slot. Then the clutched block continuously moves forward along the sliding rail and continuously drives the toggle block to rotate towards the opening direction of the sliding rail at the same time until the clutched block of the sliding rail is detached from the U-shaped opening slot of the toggle part of the toggle block while the rotary boss is positioned by the arc positioning face of the positioning slot. At that time, the sliding rail is continuously withdrawn. When the sliding rail and the fixed rail are opened, the spring is extended. When the sliding rail and the fixed rail need to be closed, the sliding rail is pushed towards the bottom of the fixed rail. When the sliding rail backwardly moves to a certain position, the clutched block of the sliding rail contacts with the concave opening slot of the toggle part of the toggle block, in such a manner that the toggle block rotates towards a closing direction with the centering boss as the shaft, and the rotary boss rotates into the guiding slot along the rotary slot. At the moment, the concave opening slot hooks the toggle block, and the sliding block drives the toggle block with a resetting force of the spring to move towards the bottom of the fixed rail along the guiding part. At the same time, the concave opening slot drives the clutched block through the toggle block, so as to drive the sliding rail to move towards the bottom of the fixed rail until the spring returns to a compacted state, in such a manner that the sliding rail is automatically closed. According to the automatic closing device of the present invention, when the sliding rail is completely opened, the rotary boss of the toggle block is positioned by the positioning slot and limited by the rotary slot of the sliding block. Therefore, positioning is reliable, which effectively avoids tilt and failure.

In addition, according to the automatic closing device of the present invention, the positioning face of the positioning slot of the guiding part of the guiding holder is the arc face extending towards the opening direction of the sliding rail, and the positioning slot is transition-connected to the guiding slot through the arc face. Therefore, when a user pushes the sliding rail towards the bottom of the fixed rail, especially pushes the sliding rail so that the clutched block is clutched in the concave opening slot of the toggle block and drives the toggle block to rotate along the arc positioning face, a resistance is small, which effectively improves sensory quality of user operation and improves comfort.

In addition, according to the automatic closing device of the present invention further comprises the reset auxiliary structure. When the sliding rail and the fixed rail are opened, the sliding block and the toggle block are limited as a whole at the most front end of the guiding part because the rotary boss is limited by the positioning slot. Furthermore, the spring is extended. When the toggle block rotates under an external force, the rotary boss is detached from the positioning slot due to spring shrinking. At this moment, the reset auxiliary structure of the toggle block cooperates with the clutched block of the sliding rail, in such a manner that the toggle block and the sliding block are easily reset to the positioning slot as a whole, so as to ensure the automatic closing device will recover before next closing.

DETAILED DESCRIPTION OF THE PREFERRED EMBODIMENT

Figure 1:
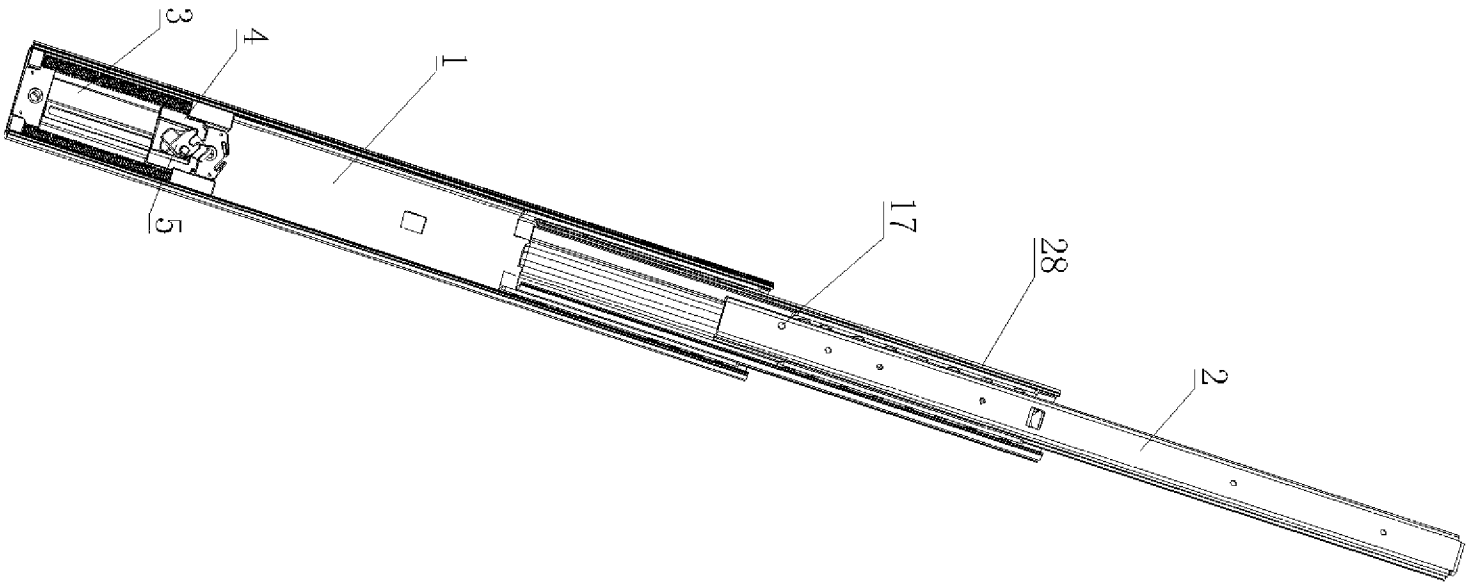
FIG. 1 is a sketch view of an automatic closing device according to the present invention.
Figure 2:
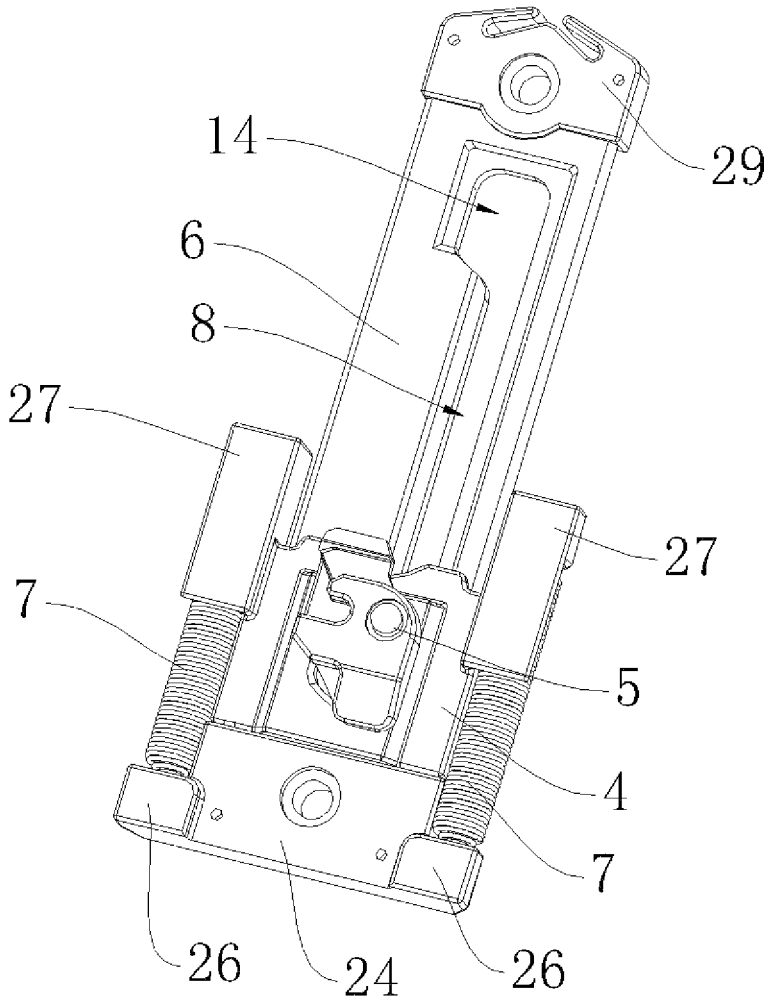
FIG. 2 is a first assembly view of a guiding holder, a sliding block and a toggle block of the automatic closing device according to the present invention.
Figure 3:
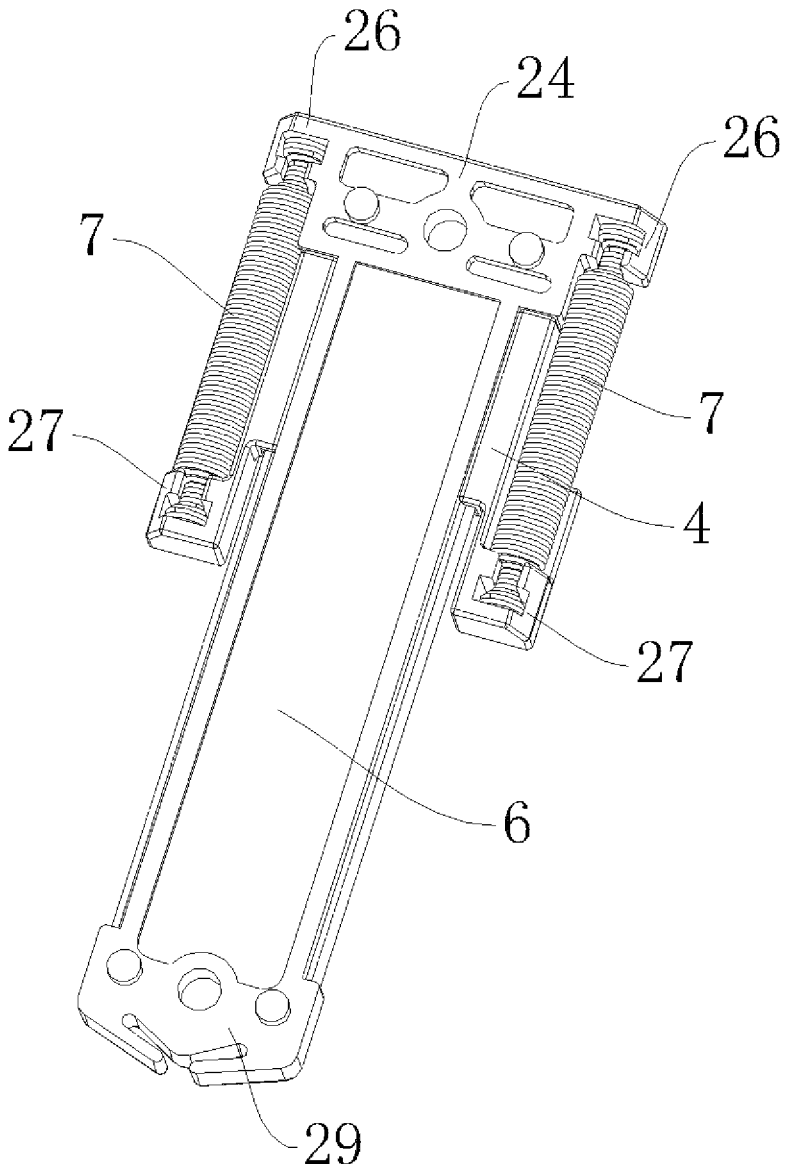
FIG. 3 is a second assembly view of the guiding holder, the sliding block and the toggle block of the automatic closing device according to the present invention.
Figure 4:
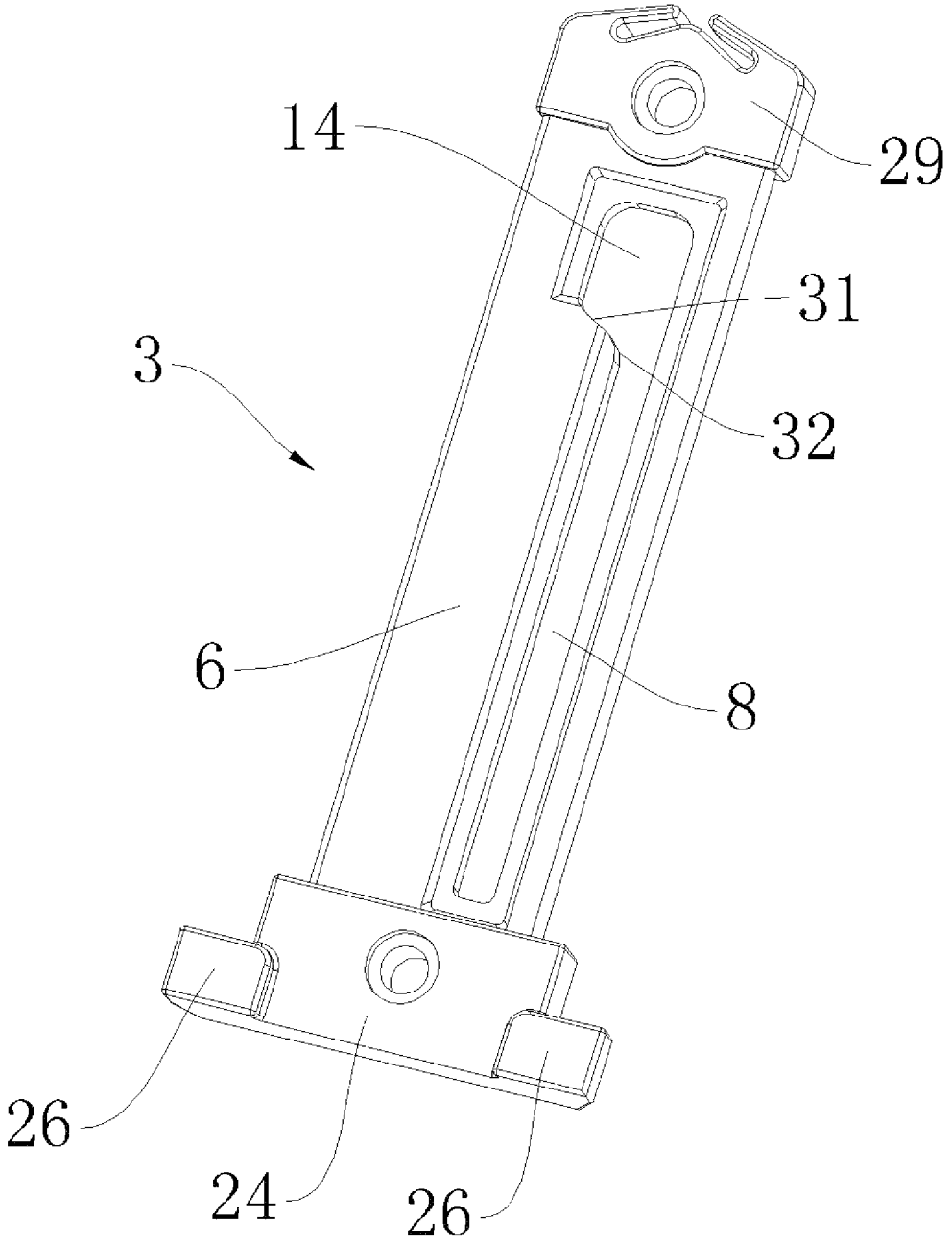
FIG. 4 is sketch view of the guiding holder of the automatic closing device according to the present invention.
Figure 5:
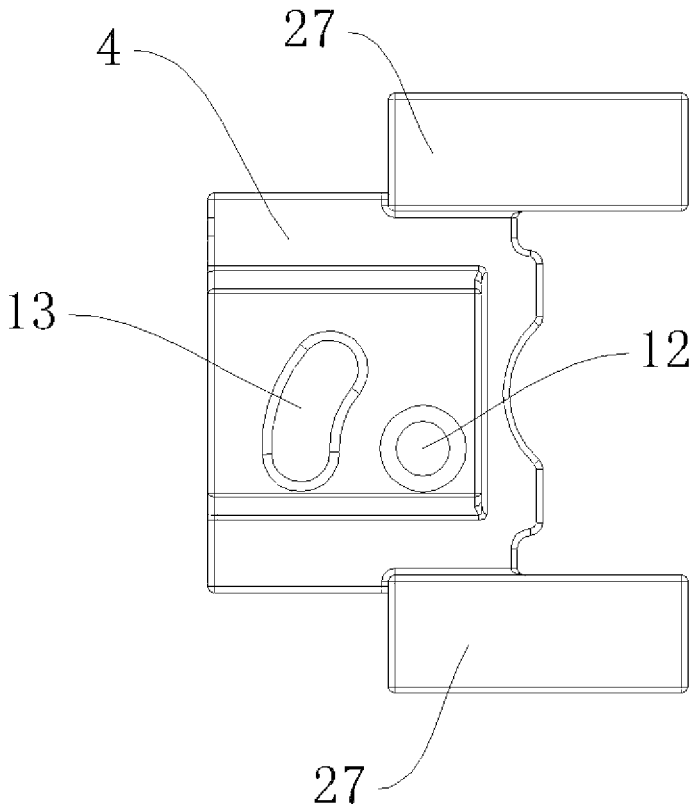
FIG. 5 is a main sketch view of the sliding block of the automatic closing device according to the present invention.
Figure 6:
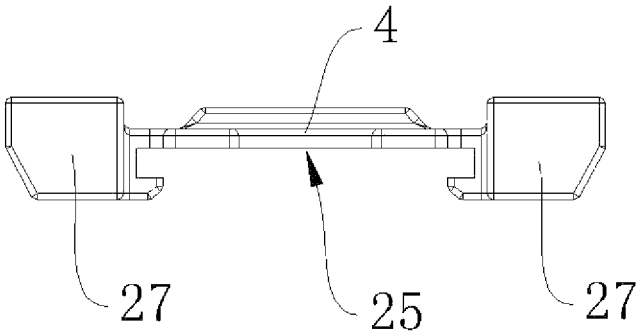
FIG. 6 is a left side view of FIG. 5.
Figure 7:
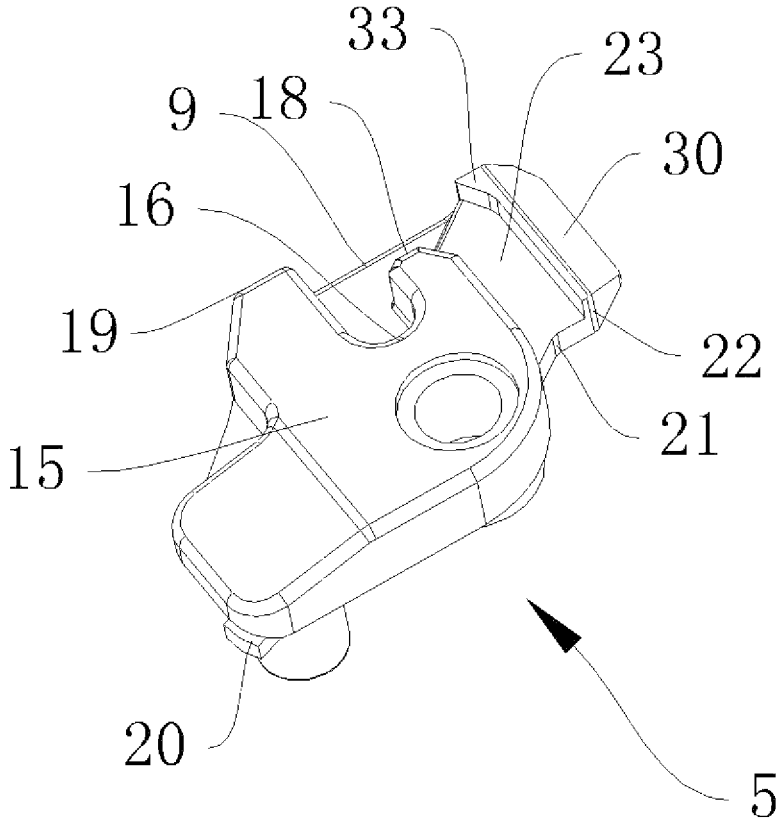
FIG. 7 is a first assembly view of the toggle block of the automatic closing device according to the present invention.
Figure 8:
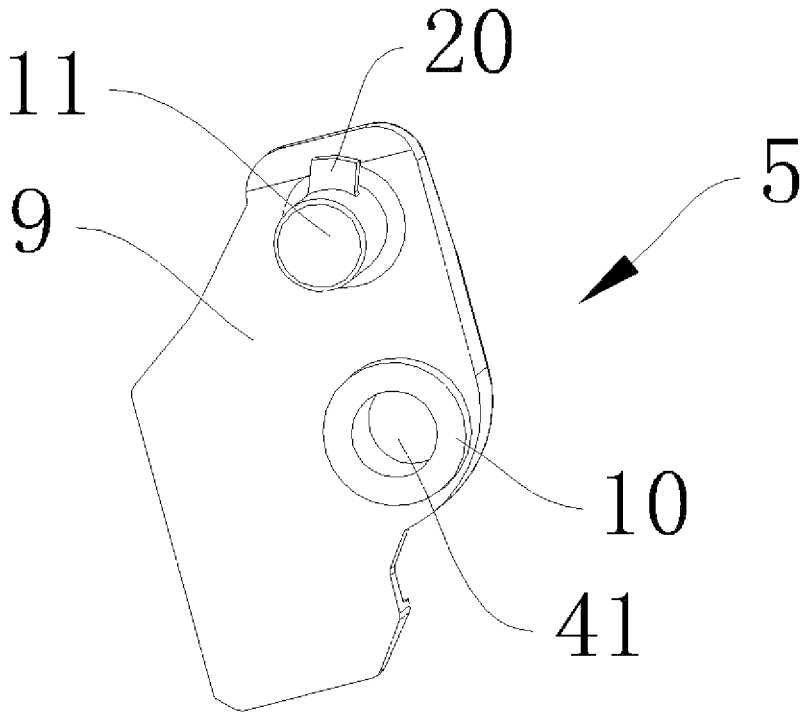
FIG. 8 is a second assembly view of the toggle block of the automatic closing device according to the present invention.
Figure 9:
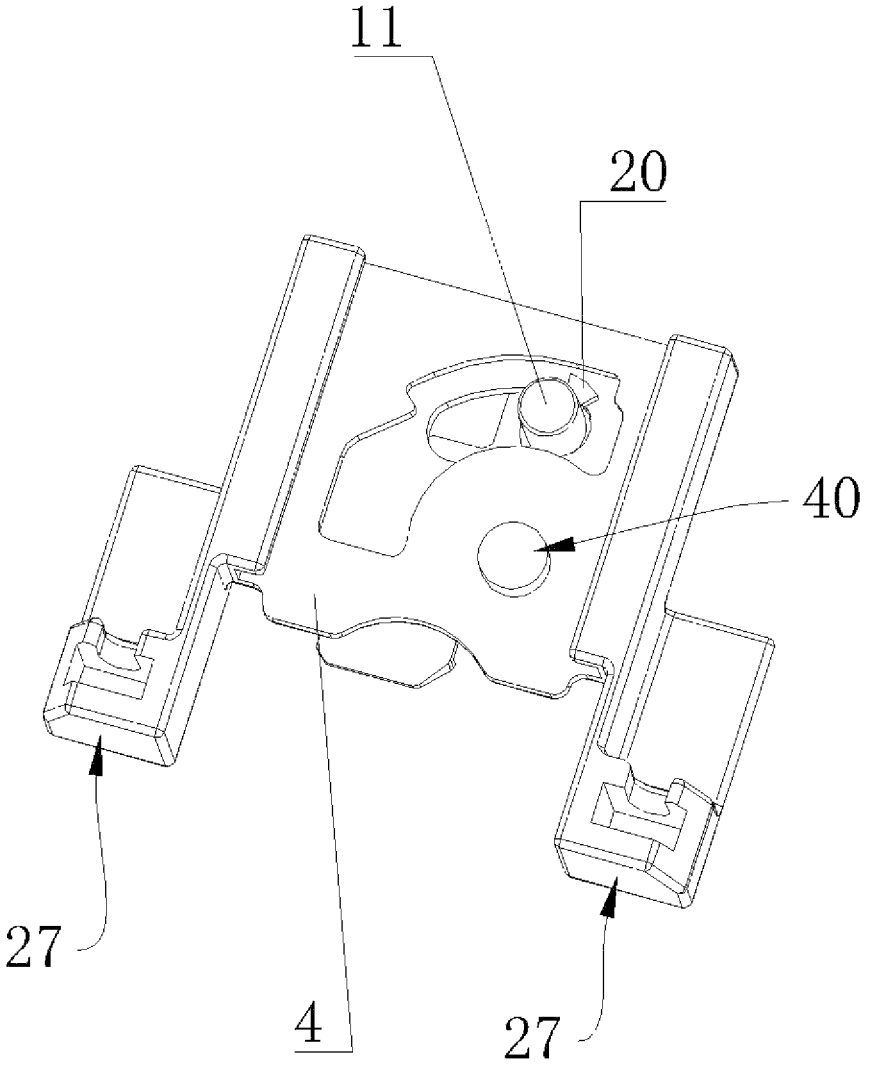
FIG. 9 is an assembly view of the sliding block and the toggle block of the automatic closing device according to the present invention.
Figure 10:
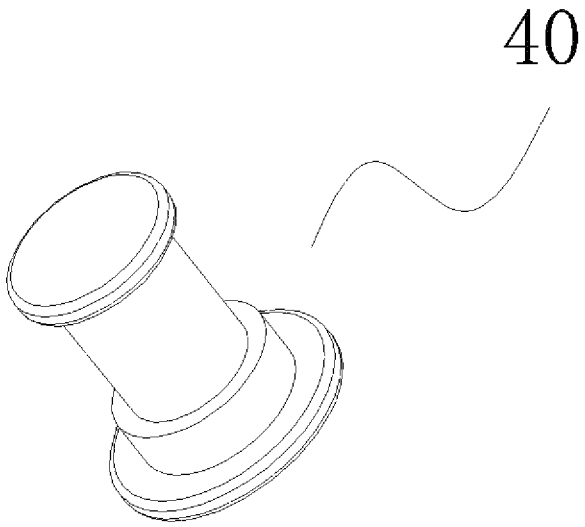
FIG. 10 is a sketch view of a connecting rivet according to the present invention.

Referring to the drawings, the present invention is further illustrated. Referring to FIGS. 1-10, an automatic closing device is provided, comprising: a fixed rail 1 and a sliding rail 2, wherein the fixed rail 1 is fixed on an object, the sliding rail 2 is mounted on a slider which relatively moves on the object, and the sliding rail 2 is installed on the fixed rail 1 through a sliding middle rail 28 according to an embodiment; wherein the automatic closing device further comprises a guiding holder 3, a sliding block 4 and a toggle block 5, wherein the guiding holder 3 is mounted on a bottom of the fixed rail 1; a guiding part 6 is mounted on the guiding holder 3 along a sliding direction of the sliding rail 2; the sliding block 4 is installed on the guiding part 6 of the guiding holder 3 and is movable along the guiding part 6; the guiding holder 3 is connected to the sliding block 4 through a spring 7; the guiding part 6 has a guiding slot 8 along the sliding direction of the sliding rail 2; the toggle block 5 comprises a bottom plate 9; a centering boss 10 and a rotary boss 11 are provided on a bottom of the bottom plate 9 of the toggle block 5; the sliding block 4 has a fixing hole 12 corresponding to the centering boss 10 and a rotary slot 13 corresponding to the rotary boss 11; the centering boss 10 passes through the fixing hole 12 of the sliding block 4, and the rotary boss 11 passes through the rotary slot 13 and extends into the guiding slot 8; when the sliding block 4 moves towards the guiding part 6, the rotary boss 11 synchronically moves in the guiding slot 8; a front end of the guiding slot 8 has a positioning slot 14 communicating with the guiding slot 8; when the rotary boss 11 moves into the positioning slot 14 along the guiding slot 8, the toggle block 5 rotates towards an opening direction of the sliding rail 2 with the centering boss 10 as a shaft, while the rotary boss 11 rotates in the positioning slot 14 along the rotary slot 13; a toggle part 15 is mounted on a bottom board of the toggle block 5, and the toggle part 15 has a concave opening slot 16; a clutched block 17 is provided on a bottom of the sliding rail 2, which is clutched in the concave opening slot 16; a first slot opening end face 18 of the concave opening slot 16 at a sliding rail opening direction side is lower than a second slot opening end face 19 of the concave opening slot 16 at a sliding rail closing direction side; a convex block 20 is provided on the rotary boss 11, and the convex block 20 hooks a bottom of the sliding block 4 after passing through the rotary slot 13. The convex block 20 is able to effectively avoid an upturned tail of the toggle block 5 due to a force applied at a front thereof. Referring to FIGS. 2 and 4, a buffer head is marked as 29, wherein when the sliding rail 2 and the fixed rail 1 are closed, the buffer head 20 provides a buffer effect for the sliding middle rail 28.

The centering boss 10 is an annular boss; after passing through the fixing hole 12 of the sliding block 4, the centering boss 10 is connected to and fixed on the sliding block 4 through a connecting rivet 40; wherein the connecting rivet 40 passes through an annular internal hole 41 of the centering boss 10. A positioning face 31 of the positioning slot 14 is an arc face 32 extending towards the opening direction of the sliding rail 2, and the positioning slot 14 is transition-connected to the guiding slot 8 through the arc face 32. A reset auxiliary structure is provided on the toggle block 5; wherein the reset auxiliary structure comprises an extending part 21 provided on the toggle part 15 at the sliding rail opening direction side, which extends towards the opening direction of the sliding rail 2; a flange 22 is provided on the extending part 21 at the sliding rail opening direction side, and a wedge-shaped face 30 is provided on the flange 22 at the sliding rail opening direction side; a ditch 23 is formed by the toggle part 15, the flange 22 and extending part 21 between the toggle part 15 and the flange 22, and the clutched block 17 of the sliding rail 2 is clutched in the ditch 23. A stopper arc end 33 is provided at a top end of the flange 22 at the sliding rail closing direction side. The concave opening slot 16 is a U-shaped opening slot; the clutched block 17 of the sliding rail 2 is cylindrical. The guiding holder 3 comprises a base 24 and the guiding part 6, wherein the guiding part 6 is perpendicularly integrated with the base 24, and the base 24 is mounted on the bottom of the fixed rail 1. A bottom of the sliding block 4 has a concave clutching slot 25, and the guiding part 6 of the guiding holder 3 is clutched in the concave clutching slot 25. Spring installation holders 26 and 27 are arranged at both sides of the guiding holder 3 and both sides of the sliding block 4; two ends of the spring 7 are respectively mounted in the spring installation holders 26 and 27 at the guiding holder 3 and the sliding block 4. The guiding slot 8 is stepped; the rotary slot 13 is an arc rotary slot; the centering boss 10 is a stepped boss; and the fixing hole 12 is a stepped hole.

Figure 11:
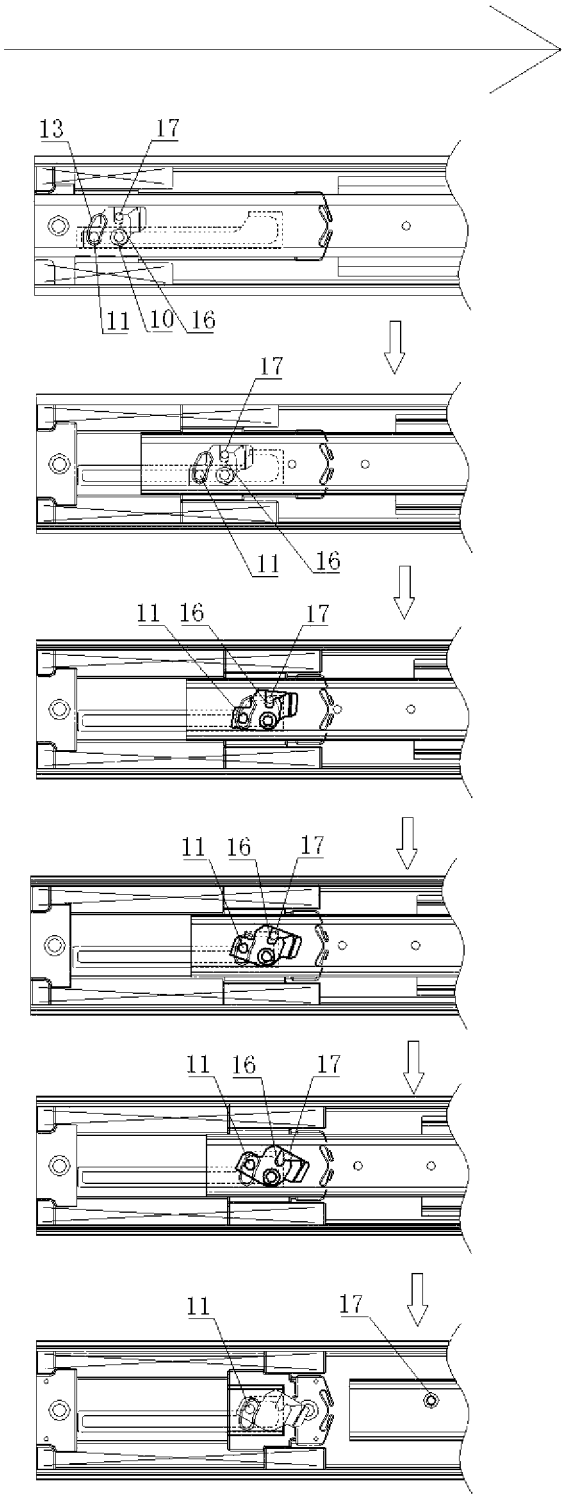
FIG. 11 illustrates a state of a fixed rail and a sliding rail during opening of the automatic closing device according to the present invention.
Figure 12:
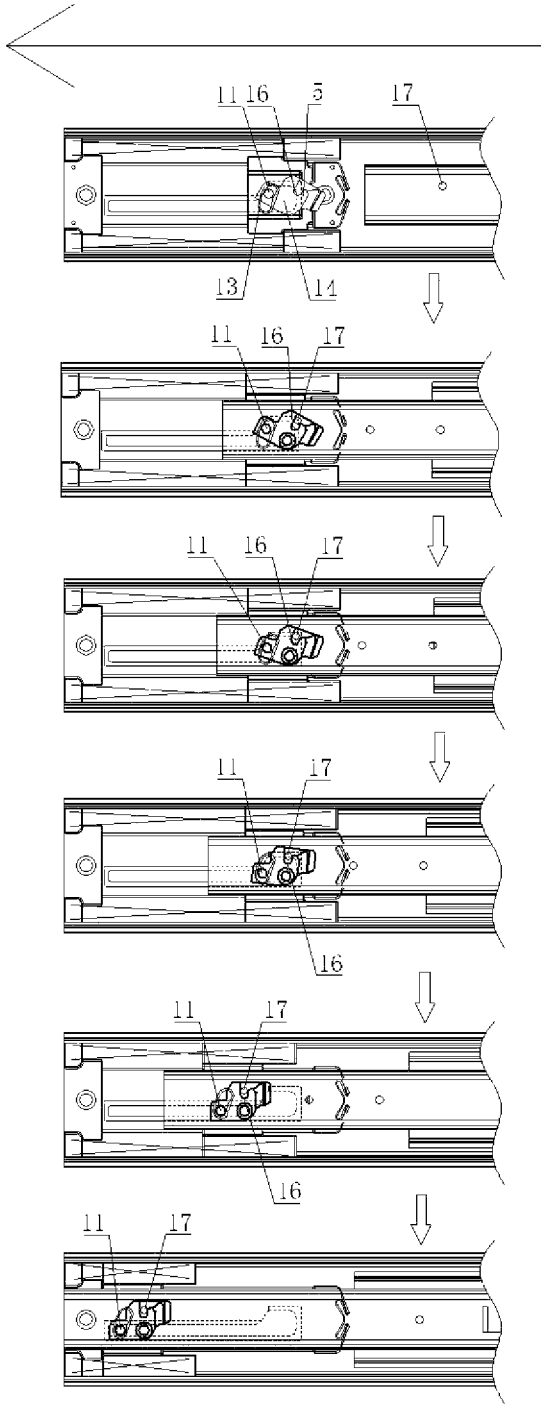
FIG. 12 illustrates a state of the fixed rail and the sliding rail during closing of the automatic closing device according to the present invention.

A working process of the automatic closing device of the present invention is illustrated as follows. Referring to FIG. 11, when the sliding rail 2 and the fixed rail 1 are closed, the rotary boss 11 is located at a bottom of the guiding slot 8 of the guiding holder 3, and the clutched block 17 on the sliding rail 2 is located at the concave opening slot 16 of the toggle part 15 of the toggle block 5. When the sliding rail 2 slides forward, the clutched block 17 on the sliding rail 2 carries the toggle block 5 to synchronically move. Meanwhile, the toggle block 5 uses the centering boss 10 to drive the guiding part 6 of the guiding holder 3 of the sliding block 4 to move forward. During a process that the clutched block 17 drives the toggle block 5 to move so that the toggle block 5 and the sliding block 4 move to a most front end of the guiding slot 8, the centering boss 10 and the rotary boss 11 of the toggle block 5 synchronically moves in the guiding slot 8. Driven by the clutched block 17, the toggle block 5 trends to rotate towards the opening direction of the sliding rail 2 with the centering boss 10 as the shaft, meanwhile the rotary boss 11 is limited by the guiding slot 8 and is not able to rotate along the rotary slot 13 of the sliding block 4. During a process that the clutched block 17 drives the toggle block 5 and the sliding block 4 to move to the most front end of the guiding slot 8 and enter the positioning slot 14, the toggle block 5 rotates towards the opening direction of the sliding rail 2 with the centering boss 10 as the shaft, while the rotary boss 11 rotates into the positioning slot 14 along the rotary slot 13. Then the clutched block 17 continuously moves forward along the sliding rail 2 and continuously drives the toggle block 5 to rotate towards the opening direction of the sliding rail 2 at the same time until the clutched block 17 of the sliding rail 2 is detached from the U-shaped opening slot 16 of the toggle part 15 of the toggle block while the rotary boss 11 is positioned by the arc positioning face 31 of the positioning slot 8. As a result, the sliding rail 2 is continuously withdrawn. When the sliding rail 2 and the fixed rail 1 are opened, the spring 7 is extended. Referring to FIG. 12, when the sliding rail 2 and the fixed rail 1 need to be closed, the sliding rail 2 is pushed towards the bottom of the fixed rail 1. When the sliding rail 2 backwardly moves to a certain position, the clutched block 17 of the sliding rail 2 contacts with the concave opening slot 16 of the toggle part 15 of the toggle block 5, in such a manner that the toggle block 5 rotates towards a closing direction of the sliding rail with the centering boss 10 as the shaft, and the rotary boss 11 rotates into the guiding slot 8 along the rotary slot 13. At the moment, the concave opening slot 16 hooks the clutched block 17, and the sliding block 4 drives the toggle block 5 with a resetting force of the spring 7 to move towards the bottom of the fixed rail 1 along the guiding part 6. At the same time, the concave opening slot 16 drives the clutched block 17 through the toggle block 5, so as to drive the sliding rail 2 to move towards the bottom of the fixed rail 1 until the spring 7 returns to a compacted state, in such a manner that the sliding rail 2 is automatically closed.

Figure 13:
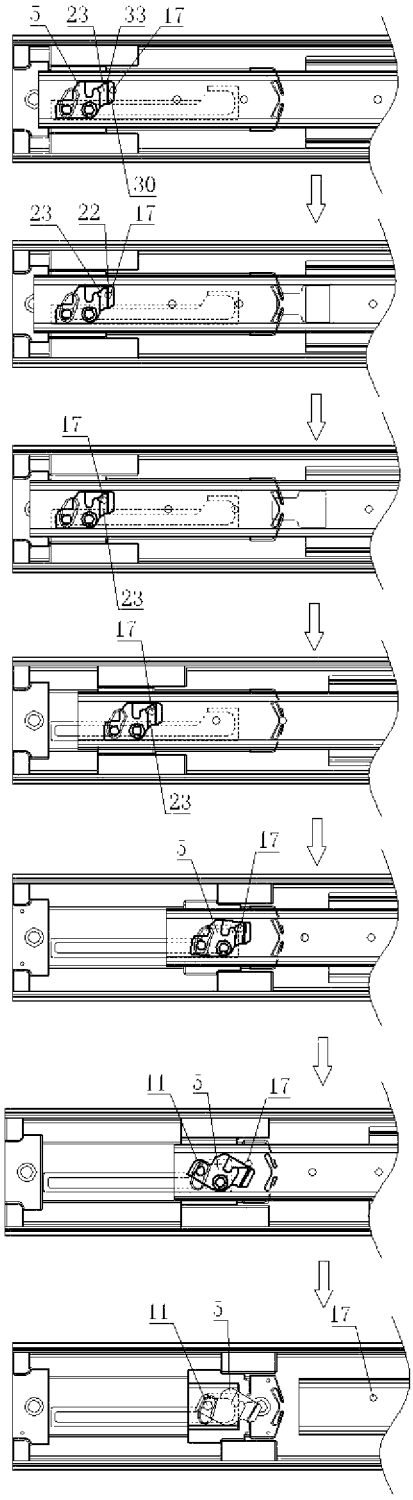
FIG. 13 is a first sketch view of a reset auxiliary structure of the toggle block cooperating with a clutched block of the sliding rail of the automatic closing device according to the present invention.
Figure 14:
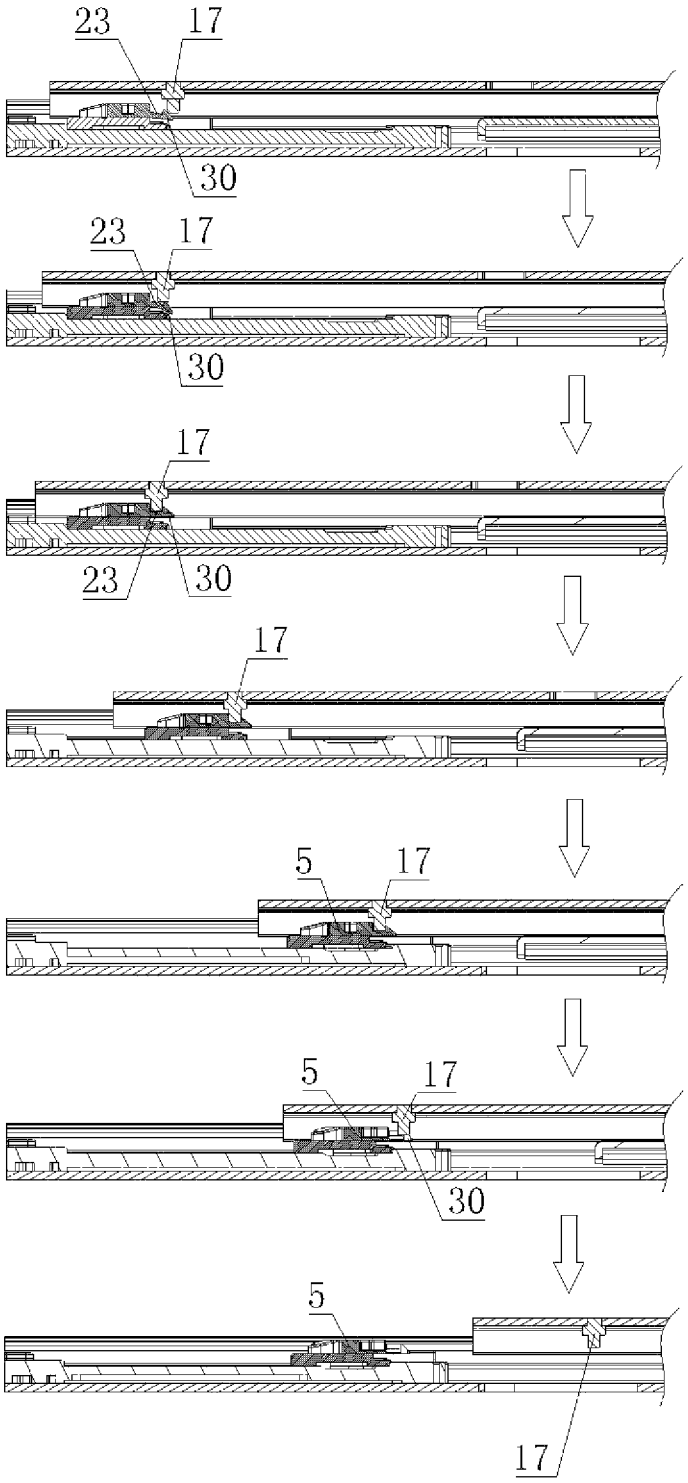
FIG. 14 is a second sketch view of the reset auxiliary structure of the toggle block cooperating with the clutched block of the sliding rail of the automatic closing device according to the present invention.
Figure 15:
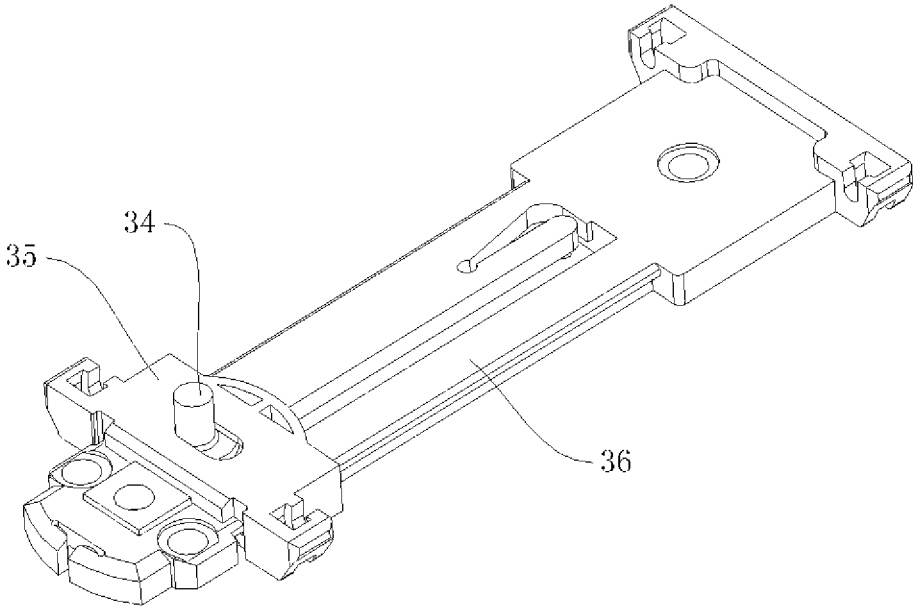
Fig. 15 (prior art)
FIG. 15 is a sketch view of an automatic closing device according to prior art.
Figure 16:
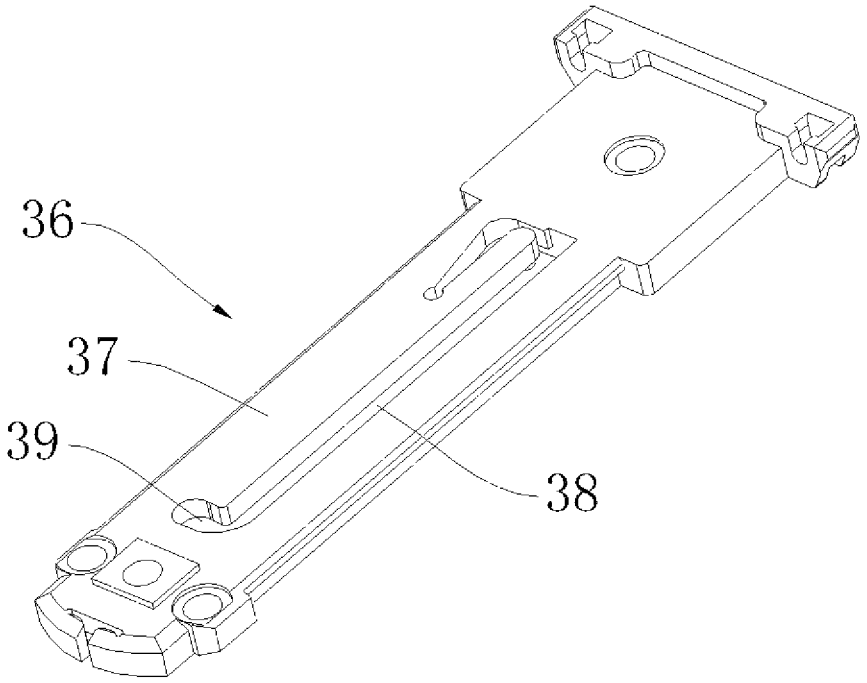
Fig. 16 (prior art)
FIG. 16 is a sketch view of plate-shaped fixing member in FIG. 15.

Referring to FIGS. 13 and 14, when the sliding rail 2 and the fixed rail 1 are opened, the sliding block 4 and the toggle block 5 are limited as a whole at the most front end of the guiding part 6 because the rotary boss 11 is limited by the positioning slot 14. Furthermore, the spring 7 is extended. When the toggle block 5 rotates under an external force, the rotary boss 11 is detached from the positioning slot 14 and returns to the bottom of the guiding slot 8 due to spring shrinking. Under such a condition, the sliding rail is pushed towards the bottom of the fixed rail 1. The clutched block 17 of the sliding rail 2 contacts with the flange 22 of the toggle block 5 before pushing the sliding rail 2 and the clutched block 17 to move along the wedge-shaped face 30 of the flange 22, while the clutched block 17 presses down the flange 22 until the clutched block 17 is clutched in the ditch 23. Then the sliding rail 2 is pulled towards the opening direction, wherein the clutched block 17 drives the toggle block 5 while the toggle block 5 drives the sliding block 4 to move towards the opening direction along the guiding part 6, until the clutched block 17 of the sliding rail 2 is detached from the U-shaped opening slot 16 of the toggle part 15 of the toggle block 5 while the rotary boss 11 is positioned by the arc positioning face 31 of the positioning slot 14. The sliding rail 2 continuously moves forward, and the clutched block 17 is detached from the ditch 23, in such a manner that the toggle block 5 and the sliding block 4 are easily reset to the positioning slot 14 as a whole, so as to ensure the automatic closing device will recover before next closing.

What is claimed is:

1. A centering-rotary positioning automatic closing device, comprising: a fixed rail and a sliding rail, wherein the fixed rail is fixed on an object, the sliding rail is mounted on a slider which relatively moves on the object, and the sliding rail is installed on the fixed rail in a sliding form; wherein the centering-rotary positioning automatic closing device further comprises a guiding holder, a sliding block and a toggle block, wherein the guiding holder is mounted on a bottom of the fixed rail; a guiding part is mounted on the guiding holder along a sliding direction of the sliding rail; the sliding block is installed on the guiding part of the guiding holder and is movable along the guiding part; the guiding holder is connected to the sliding block through a spring; the guiding part has a guiding slot along the sliding direction of the sliding rail; the toggle block comprises a toggle part; a centering boss and a rotary boss are provided on a bottom of the toggle part; the sliding block has a fixing hole corresponding to the centering boss and a rotary slot corresponding to the rotary boss; the centering boss passes through the fixing hole of the sliding block, and the rotary boss passes through the rotary slot of the sliding block and extends into the guiding slot; when the sliding block moves towards the guiding part, the rotary boss synchronically moves in the guiding slot; a front end of the guiding slot has a positioning slot communicating with the guiding slot; when the rotary boss moves into the positioning slot along the guiding slot, the toggle block rotates towards an opening direction of the sliding rail with the centering boss as a shaft, while the rotary boss rotates in the positioning slot along the rotary slot; the toggle part is mounted on a bottom board of the toggle block, and the toggle part has a concave opening slot; a clutched block is provided on a bottom of the sliding rail, which is clutched in the concave opening slot; a first slot opening end face of the concave opening slot at a sliding rail opening direction side is lower than a second slot opening end face of the concave opening slot at a sliding rail closing direction side; wherein the centering boss is an annular boss; after passing through the fixing hole of the sliding block, the centering boss is connected to and fixed on the sliding block through a connecting rivet; wherein the connecting rivet passes through an annular internal hole of the centering boss.

2. The centering-rotary positioning automatic closing device, as recited in claim 1, wherein a positioning face of the positioning slot is an arc face extending towards the opening direction of the sliding rail, and the positioning slot is transition-connected to the guiding slot through the arc face.

3. The centering-rotary positioning automatic closing device, as recited in claim 1, wherein a convex block is provided on the rotary boss, and the convex block hooks a bottom of the sliding block after passing through the rotary slot.

4. The centering-rotary positioning automatic closing device, as recited in claim 1, wherein a reset auxiliary structure is provided on the toggle block; wherein the reset auxiliary structure comprises an extending part provided on the toggle part at the sliding rail opening direction side; a flange is provided on the extending part at the sliding rail opening direction side, and a wedge-shaped face is provided on the flange at the sliding rail opening direction side; a ditch is formed by the toggle part, the flange and the extending part between the toggle part and the flange, and the clutched block of the sliding rail is clutched in the ditch.

5. The centering-rotary positioning automatic closing device, as recited in claim 4, wherein a stopper arc end is provided at a top end of the flange at the sliding rail closing direction side.

6. The centering-rotary positioning automatic closing device, as recited in claim 1, wherein the guiding holder comprises a base and the guiding part, wherein the guiding part is perpendicularly integrated with the base, and the base is mounted on the bottom of the fixed rail.

7. The centering-rotary positioning automatic closing device, as recited in claim 1, wherein a bottom of the sliding block has a concave clutching slot, and the guiding part of the guiding holder is clutched in the concave clutching slot.

8. The centering-rotary positioning automatic closing device, as recited in claim 1, wherein spring installation holders are arranged at both sides of the guiding holder and both sides of the sliding block; two ends of the spring are respectively mounted in the spring installation holders at the guiding holder and the sliding block.

9. The centering-rotary positioning automatic closing device, as recited in claim 1, wherein the concave opening slot is a U-shaped opening slot; the clutched block of the sliding rail is cylindrical; the guiding slot is stepped; the rotary slot is an arc rotary slot; the centering boss is a stepped boss; and the fixing hole is a stepped hole.

* * * * *